United States Patent [19]

Marshall et al.

[11] Patent Number: 4,470,816

[45] Date of Patent: Sep. 11, 1984

[54] THERMAL SIGHT TRAINER

[75] Inventors: Albert H. Marshall, Orlando; Bon F. Shaw, Winter Park, both of Fla.

[73] Assignee: The United States of America as represented by the Secretary of the Navy, Washington, D.C.

[21] Appl. No.: 474,766

[22] Filed: Mar. 14, 1983

[51] Int. Cl.[3] ..... F41J 5/08

[52] U.S. Cl. ..... 434/20; 434/43; 434/22

[58] Field of Search ..... 434/20, 21, 22, 43

[56] References Cited

U.S. PATENT DOCUMENTS 3,964,178 6/1976 Marshall et al. ..... 434/20

4,336,018 6/1982 Marshall et al. ..... 434/20

*Primary Examiner*—Richard C. Pinkham

*Assistant Examiner*—Leo P. Picard

*Attorney, Agent, or Firm*—Robert F. Beers; Robert W. Adams; Robert J. Veal

[57] ABSTRACT

A simulated thermal sight utilizes a computer to store digitized video data derived from photographs of actual thermal images. The computer inserts video images formed from the data into optical telescopes, via a miniature TV and mirror system, to simulate a thermal image for a trainee. An IR detector and emitter, whose location corresponds to the apparent location of the thermal image, are used to measure aim error and provide an input to the computer.

14 Claims, 1 Drawing Figure

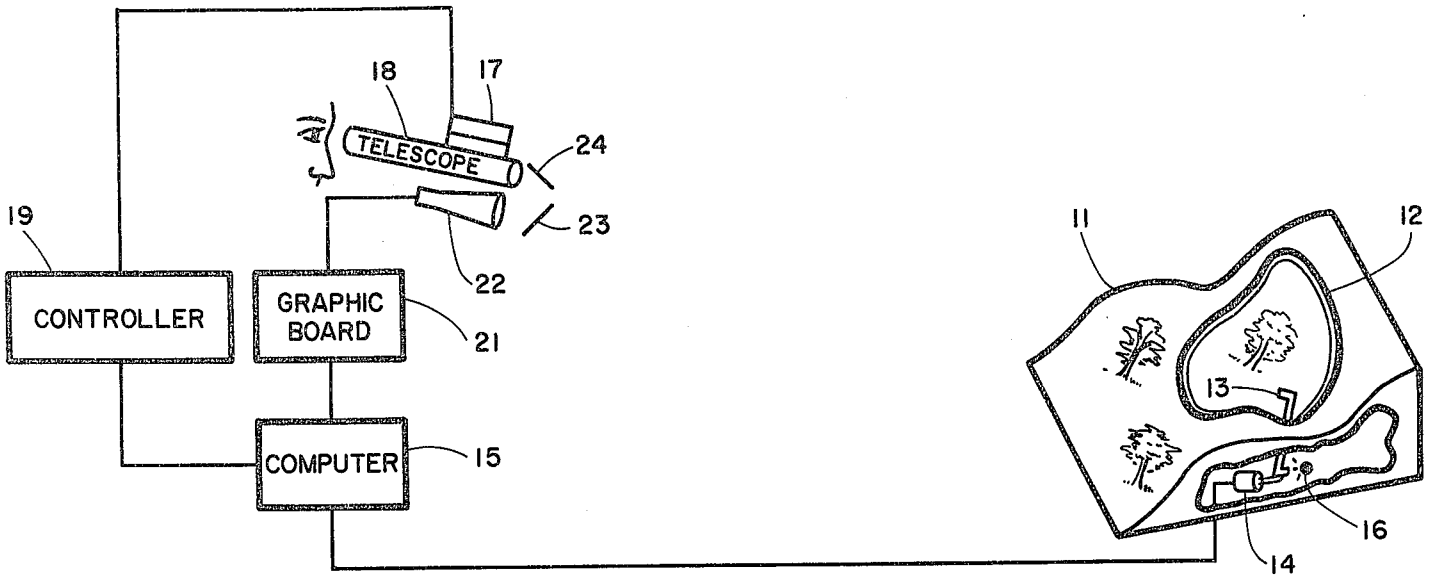
12
11
13
16
14
24
23
17
22
21
15
18
TELESCOPE
GRAPHIC BOARD
COMPUTER
CONTROLLER
19

THERMAL SIGHT TRAINER

BACKGROUND OF THE INVENTION

The present invention relates to weapons training and in particular to training with weapons utilizing thermal sights. More particularly the invention relates to weapons training wherein simulated thermal sights are used, and in even greater particularity this invention relates to simulated thermal sights and the images viewed therewith.

The advances of modern technology have enabled combat troops to engage the enemy in the face of visibility conditions which once would have severely limited their effectiveness. One of the foremost advances has been the thermal sight, which provides visible images which otherwise are obscured by darkness, smoke, or other atmospheric conditions. The recognition and identification of these thermal images determines the effectiveness of the utilization of the sights.

DESCRIPTION OF THE PRIOR ART

Inasmuch as training with operational targets and sights is a costly and precarious undertaking, numerous concepts have been advanced for alternative training methods. Many have used infrared emitters to determine aim deviation. Examples of such use are U.S. Pat. No. 4,336,018, Electro-Optic Infantry Weapons Trainer, and U.S. Pat. No. 3,964,178, Universal Infantry Weapons Trainer. In addition, a number of attempts have been made to simulate thermal targets by such means as pyrotechnic devices, etched grids on targets, and various lighting means, all of which have served limited purposes and have addressed part of the problem associated with weapons training by simulation within a limited area, for example indoors.

SUMMARY OF THE INVENTION

The present invention provides for the training of troops in the use of thermal sights within a small area, and preferably indoors. The invention relies on a modelboard for the background terrain and an infrared source movably mounted on said terrain board as a target location indicator. Actual thermal images taken from operational sights are stored as digitized video signals in a computer. The computer also calculates the divergence of a telescopic sight from the target on the basis of data input from a photodetector system aligned with the telescope, and controls the motion of the IR source. The digitized video data is output to a television monitor and superimposed therefrom into the telescopic sight in correspondence with the IR source location.

It is therefore a principle object of this invention to provide to the trainee a simulated scenario which realistically reproduces thermal images he will encounter.

Another object of the invention is to provide a plurality of thermal images, selectable at random to provide comprehensive thermal signature recognition.

Yet another object of the invention is to provide a low cost method of training in the use of thermal sights within a confined area.

These and other object, advantages, and features of the invention will become apparent from the following detailed description when read in conjunction with the accompanying drawings.

BRIEF DESCRIPTION OF THE DRAWING

The FIGURE is a block diagram of the invention.

DESCRIPTION OF A PREFERRED EMBODIMENT

In the form of the invention illustrated in the drawing, there is provided a modelboard 11, wherein there is a slot 12 which may be of any predetermined length or configuration. Slot 12 is of sufficient width to permit a formed fiber optic bundle (FOB) 13 to pass therethrough and slide freely along the length of said slot 12. FOB 13 traverses slot 12 at the impetus of a stepper motor 14 which is controlled by a computer 15. Beneath board 11 and adjacent the lower end of FOB 13 is an infrared emitter 16 which emits infrared radiation to be transmitted through FOB 13.

The infrared radiation thus transmitted is detected by a matrix array photodetector 17 which is mounted to and aligned with a telescopic sight 18. The matrix array photodetector 17 outputs a signal which indicates the position of the output end of FOB 13 with respect to the optical axis of telescopic sight 18. The output of photodetector 17 is read by a controller 19 which then transmits a digital output to computer 15, wherein a cacluation is performed to determine the divergence between FOB 13 and sight 18.

Sight 18 is preferably an optical telescope of the same magnification and field of view as an operational thermal sight. The matrix array photodetector 17 may be a Model MC 520 camera; controller 19 may be a Model RS 520 controller, both made by Reticon, Inc. of Sunnyvale, CA.

Computer 15 has stored within its memory a plurality of digitized video representations of thermal images. Thermal images may be captured directly from the thermal sight display of a thermal image of a real target, or on a photograph of such a display. A television camera is then used to convert the image into a video signal. The video signal may then be stored on video tape, a video disc, or preferentially in digital format in a computer memory. In the preferential method, the video data is digitized using a frame grabber such as the MATROX-FG-04. The output of the frame grabber is digital data which can be stored in the computer memory.

Computer 15 has an output to a graphics board 21, such as a MATROX RGB-256 model, where the digital video data is reconstructed into a TV video signal and input into a TV tube 22. A mirror 23 is cooperatively positioned to reflect images from TV tube 22 to a beam splitter 24 which superimposes the TV images on the terrain seen through sight 18. The superimposed image is adjusted by computer 15 to correspond to the position of FOB 13 within the field of view of sight 18 in accordance with the signal received from photodetector 17.

As hereinabove noted, computer 15 has an output to stepper motor 14 for controlling the movement of FOB 13 about terrain board 11 in accordance with a predetermined pattern.

In operation, FOB 13 moves about terrain board 11 within slot 12 under the impetus of stepper motor 14. As FOB 13 moves, it emits IR generated by IR emitter 16. The trainee scans the terrain board through telescopic sight 18, which causes photodetector 17 to also so scan. When photodetector 17 senses the output of FOB 13, a digital signal is sent to computer 15 from which computer 15 can determine the location of FOB 13 within the field of view of photodetector 17 which corresponds to the FOV of the telescopic sight 18. Computer 15 then sends a digitized video signal to graphics board 21 for reconstruction into a TV image which will be superimposed in telescopic sight 18 at a position corresponding to the position of FOB 13. As sight 18 is moved or as FOB 13 is moved, computer 15 maintains the proper positioning of the simulated thermal image within the field of view of telescopic sight 18.

It is noteworthy to mention that the thermal images thus provided are the exact reproduction of the operational sight, including thermal images of personnel as well as vehicles. Thus it can be seen that the complete thermal scenario can be simulated in this manner, thereby providing a marked improvement in the training efficiency in terms of quality and cost.

While the invention has been described with reference to a preferred embodiment, it will be appreciated by those skilled in the art that additions, deletions, modifications and substitutions or other changes not specified may be made which will fall within the purview of the appended claims.

What is claimed is:

1. An apparatus for simulating a thermal sight comprising:

a telescopic sight;

means for transmitting infrared radiation (IR) movably positioned within view of said sight;

means for sensing said IR boresighted to said sight and having an output in accordance therewith;

means for inserting pseudo-thermal images into said sight;

means for controlling the position of said transmitting means and coordinating said inserting means with said sensing means to present a pseudo-thermal image in said sight corresponding to the position of said transmitting means in relation to said sight, having an input from said sensing means, an output to said inserting means, and an output to said transmitting means.

2. The apparatus of claim 1, wherein said transmitting means comprises:

a fiber optic bundle having a first end for receiving light and a second end for transmitting light toward said telescopic sight;

a source of IR cooperatively positioned for the transmission of radiation through said fiber optic bundle; and means for varying the position of said second end of said fiber optic bundle under the direction of said controlling means.

3. The apparatus of claim 2, wherein said varying means is a stepper motor.

4. The apparatus of claim 3, further comprising a terrain board having therethrough a slot of predetermined width and configuration through which said second end of said fiber optic bundle extends.

5. The apparatus of claim 1, wherein said sensing means comprises:

a photodetector matrix array boresighted with said telescopic sight and having an input-output terminal; and controller having an input-output terminal connected to the input-output terminal of said photodetector matrix array, and an output to said coordinating means.

6. The apparatus of claim 1, wherein said inserting means comprises:

an image generating device operably connected to said coordinating means to receive digital video information, including a graphics board and a television picture tube;

a mirror cooperatively positioned to reflect the image generated on said picture tube; and a beam splitter cooperatively positioned to superimpose said image on the scene viewed through said telescope.

7. The apparatus of claim 1, wherein said coordinating means comprises:

a computer having an input from said sensing means, an output to said inserting means, and a memory wherein: a plurality of digital video signals are stored for output to said inserting means, and a program for determining alignment of said telescopic sight and said light transmitting means is stored.

8. An apparatus for simulating a thermal sight comprising:

a terrain board having therein a slot of predetermined width and configuration;

a fiber optic bundle extending through said terrain board via said slot, having a definite direction of propagation of light transmitted therethrough, a source of infrared radiation cooperatively positioned to provide IR for transmission through said terrain board via said fiber optic bundle;

means for moving said fiber optic bundle about said terrain board within said slot;

a telescopic sight;

means for sensing said IR transmitted via said fiber optic bundle mounted on said telescopic sight and having an output from which said sight's optical alignment with said bundle may be determined;

a miniature television picture tube, having an input and located proximal said telescopic sight, whereby images may be produced;

mirror means for reflecting images produced by said television tube cooperatively positioned therefor;

beam splitter means for combining light from said terrain board with images reflected from said mirror to form a composite scene to be viewed through said telescopic sight; and computer means receiving an input from said sensing means and having an output to said TV tube and said moving means, programmed to calculate deviations in said telescopic sight's optical alignment with said fiber optic bundle and to control said moving means, having stored within an internal memory digitized TV images for output to said TV tube in accordance with said calculated deviation.

9. The apparatus of claim 8 wherein said moving means comprises a stepper motor having an input from said computer means.

10. The apparatus of claim 8 wherein said sensing means comprises:

a photodetector matrix array mounted to and aligned with said telescopic sight and having an input-output terminal; and a controller having an input-output terminal connected to the input-output terminal of said photodetector matrix array and an output connected to said computer means.

11. A method of training in the use of an infrared sight comprising the steps of:

making video recordings of thermal images presented by operational infrared sights;

selecting desired aspect angles and particular images for use in training;

converting video data corresponding to said selections into digital data;

storing said digital data in a computer memory;

moving an IR source on a modelboard under the control of said computer;

sensing said IR source proximal a telescopic sight;

determining the deviation of said IR source from the optical axis of said sight;

generating video images from said digital video data; and inserting said generated video into said sight in correspondence with said IR source.

12. The method of claim 11 wherein said making step comprises:

photographing a thermal image of a target through an operational infrared sight; and converting the static image in the photograph into a video signal by means of a TV camera.

13. The method of claim 11 wherein said moving step comprises incrementing a stepper motor attached to an IR emitter on said modelboard.

14. The method of claim 11 wherein said sensing step comprises scanning each detector in a matrix array photodetector in a systematic manner and outputting a video signal in accordance therewith.

* * * * *